US009914004B2

(12) United States Patent
Hatfield

(10) Patent No.: US 9,914,004 B2
(45) Date of Patent: Mar. 13, 2018

(54) DEVICE AND METHOD FOR PASSIVE FLEXIBILITY TRAINING

(71) Applicant: Keith Howard Hatfield, Tallahassee, FL (US)

(72) Inventor: Keith Howard Hatfield, Tallahassee, FL (US)

( * ) Notice: Subject to any disclaimer, the term of this patent is extended or adjusted under 35 U.S.C. 154(b) by 0 days.

(21) Appl. No.: 13/942,480

(22) Filed: Jul. 15, 2013

(65) Prior Publication Data

US 2014/0018216 A1 Jan. 16, 2014

Related U.S. Application Data

(60) Provisional application No. 61/671,386, filed on Jul. 13, 2012.

(51) Int. Cl.
*A63B 21/00* (2006.01)
*A61H 1/02* (2006.01)

(52) U.S. Cl.
CPC ..... *A63B 21/00185* (2013.01); *A61H 1/0266* (2013.01); *A61H 2201/0153* (2013.01); *A61H 2201/1253* (2013.01); *A61H 2201/165* (2013.01); *A61H 2201/1609* (2013.01); *A61H 2201/1635* (2013.01); *A61H 2201/1642* (2013.01)

(58) Field of Classification Search
CPC ..... A63B 2023/006; A63B 21/0442; A63B 21/00185; A63B 2201/1269; A63B 2201/1276; A63B 21/00178; A63B 21/0023; A63B 21/4011; A63B 21/4015; A63B 2023/03508; A63B 23/10; A63B 2208/0238; A61F 5/04; A61F 5/042; A61H 2201/1642; A61H 2201/165; A61H 1/0266; A61H 2201/1635; A61H 2201/0153; A61H 2201/1253; A61H 2201/1609; A61H 1/0237; A61H 1/02; A61H 2201/164; A61H 2201/1645; A61H 2201/1647; A61H 2201/1652; A61H 2203/0437; A61H 2203/0462; A61H 2205/10; A61H 2205/106; A61H 2205/12; A61H 2205/125
USPC ..... 482/124, 131, 907; D24/190; 601/45
See application file for complete search history.

(56) References Cited

U.S. PATENT DOCUMENTS 324,498 A * 8/1885 Surbaugh ..... 601/45
504,598 A * 9/1893 Leyda ..... 601/45
846,648 A * 3/1907 Crume ..... A61B 17/42 601/45
1,608,032 A * 11/1926 McNabb ..... 602/30
1,734,238 A * 11/1929 Sweeney ..... A63B 21/0004 482/123

(Continued)

*Primary Examiner* — Joshua Lee
(74) *Attorney, Agent, or Firm* — Adrienne C. Love

(57) ABSTRACT

The present invention comprises a device and method for achieving a passive stretch, wherein the device has an anchor, a foot strap, a handle strap and at least one handle. The anchor secures the device to the user such that an opposing force can be applied to the device. A foot strap is attached to the anchor and extends under the heel and plantar surface of the user's foot. The foot strap maintains contact with the user's entire foot. The foot strap extends past the user's toes and connects to a set of handles by way of a handle strap. The user can apply force by pulling the handles toward the user's body thereby achieving a stretch through the user's foot and calf muscle, into the hamstring muscle in particular embodiments.

18 Claims, 5 Drawing Sheets

(56) References Cited

U.S. PATENT DOCUMENTS 3,162,442 A * 12/1964 Laddie ..... 482/124
3,659,846 A * 5/1972 Kanicki ..... 482/129
4,209,012 A * 6/1980 Smucker ..... A61B 19/00 128/845
4,251,070 A * 2/1981 Leseberg ..... A63B 21/154 36/50.1
4,669,450 A * 6/1987 Lindberg ..... A61H 1/0266 482/80
4,728,103 A * 3/1988 Fulton ..... 482/125
5,100,129 A * 3/1992 Porter et al. ..... 482/129
5,167,601 A * 12/1992 Frappier ..... 482/121
5,256,119 A * 10/1993 Tudor ..... 482/74
5,582,579 A * 12/1996 Chism ..... A61H 1/0259 482/79
5,688,213 A * 11/1997 Recker ..... A63B 21/0004 482/125
5,716,307 A * 2/1998 Vadher ..... A43B 7/20 482/124
5,820,534 A * 10/1998 Vadher ..... A63B 21/055 482/124
5,853,354 A * 12/1998 Kubota ..... A63B 23/085 482/80
6,004,282 A * 12/1999 Whitley ..... 602/5
6,129,691 A * 10/2000 Ruppert ..... A61F 5/026 128/845
6,179,760 B1 * 1/2001 Rumbaugh ..... A41D 13/0015 482/121
6,206,807 B1 * 3/2001 Cowans ..... A61H 1/0266 482/79
6,368,258 B1 * 4/2002 Emlaw ..... 482/124
6,450,131 B1 * 9/2002 Broman ..... A61F 5/026 119/857
6,450,930 B1 * 9/2002 Kroke ..... 482/121
6,530,893 B1 * 3/2003 Castelli ..... A61F 5/0118 602/32
6,540,651 B1 * 4/2003 Aberton ..... A63B 21/04 482/124
7,179,206 B2 * 2/2007 Backes et al. ..... 482/80
7,207,932 B1 * 4/2007 Dean ..... A63B 23/0211 482/140
7,223,212 B2 * 5/2007 DiOrio ..... A63B 21/0023 482/83
7,654,921 B2 * 2/2010 Brunst ..... A63B 69/0002 473/422
7,955,236 B2 * 6/2011 DiGiovanni et al. ..... 482/124
7,998,041 B1 * 8/2011 Johnson ..... A63B 21/0552 482/124
8,088,088 B2 * 1/2012 Hurley ..... A61F 5/026 119/857
8,142,336 B1 * 3/2012 Yates ..... A61H 1/0255 482/124
8,403,817 B2 * 3/2013 Ferguson ..... A63B 21/4025 482/74
D694,414 S * 11/2013 Sparkes ..... D24/190
2004/0192520 A1 * 9/2004 Wilcocks ..... A63B 21/0004 482/124
2007/0149368 A1 * 6/2007 Koch ..... 482/131
2008/0009398 A1 * 1/2008 Grisdale ..... 482/124
2008/0229501 A1 * 9/2008 Hutchison ..... A45C 13/30 5/420
2008/0293550 A1 * 11/2008 Campbell ..... A63B 21/0004 482/121
2011/0282256 A1 * 11/2011 Carroll ..... 602/20
2012/0040808 A1 * 2/2012 Khademi ..... A63B 21/00043 482/124
2012/0295779 A1 * 11/2012 Ferguson, Jr. ..... 482/131
2013/0059704 A1 * 3/2013 McCants ..... 482/131
2013/0079201 A1 * 3/2013 Morgan ..... 482/124
2013/0310232 A1 * 11/2013 Flores ..... A63B 17/00 482/131
2013/0345032 A1 * 12/2013 Aldridge ..... 482/131

* cited by examiner 36
38
40
42

DEVICE AND METHOD FOR PASSIVE FLEXIBILITY TRAINING

CROSS-REFERENCES TO RELATED APPLICATIONS

Pursuant to the provisions of 37 C.F.R. § 1.53(c), this non-provisional application claims the benefit of an earlier-filed provisional patent application. The earlier application was assigned Ser. No. 61/671,386. It lists the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to an exercise device and method of use thereof for the foot, ankle, knee and lower back, and more particularly to a passive stretch exercise device and method of use thereof.

2. Description of the Related Art

Injuries relating to the foot, ankle, knee and lower back are extremely common. Injuries such as sprains, strains and fractures can occur at any time, such as when walking, during active exercise, and during sports competitions. Left untreated these injuries often result in residual effects such as loss of balance and local weakness. Stretching a specific muscle or tendon can help to treat these types of injuries.

Stretching can be therapeutic in order to alleviate cramps, reduce the risk of injury and/or increase performance. Additionally, stretching a specific muscle or tendon can assist with increased muscle control, flexibility and range of motion.

Passive stretching is a type of stretching in which an external force exerts upon the body part to move it into a new position. The user's body is relaxed as the muscle or tendon is stretched. It is normally achieved by using the force of gravity or another individual or device. Active stretching eliminates external forces. In order to achieve an active stretch, the user contracts one muscle thereby stretching the opposing muscle. There are benefits to both active and passive stretching. For example, it is thought that active stretching is beneficial to prepare a muscle for action while passive stretching is beneficial for increasing the range of motion. Effective rehabilitative physical therapy must include passive flexibility stretching exercises that increase the range of motion of the injured muscle or tendon to help prevent recurrent injury, speed recovery, and/or reduce pain.

Several devices are known which allow individuals to employ stretching exercises of the foot, ankle, knee, and tower back. Among these are exercise devices which include a foot strap, a pull strap, a handle, and a resistance band. However, it is difficult for an individual to achieve a purely passive stretch when using the prior art devices. This is primarily due to the fact that most devices require the user to contract certain muscles or place a limb in a position that is not a relaxed state in order to obtain the device-assisted stretch.

Therefore what is needed is a stretching device and method which allows an individual to maintain a relaxed position to achieve a quality passive stretch. The present invention achieves this objective, as well as others that are explained in the following description.

BRIEF SUMMARY OF THE INVENTION

The present invention comprises a device and method for achieving a passive stretch having an anchor, a foot strap, a handle strap and a handle. The anchor secures the device to the user such that an opposing force can be applied to the device. A foot strap is attached to the anchor and extends under the heel and plantar surface of the user's foot. The foot strap maintains contact with the user's entire foot. The foot strap extends past the user's toes and connects to a set of handles by way of a handle strap. The user can apply force by pulling the handles toward the user's body thereby achieving a stretch through the user's foot and calf muscle, into the hamstring muscle in particular embodiments.

REFERENCE NUMERALS IN THE DRAWINGS

| | | | |
|---|---|---|---|
| 10 | device | 12 | foot strap |
| 14 | anchor | 16 | handle |
| 18 | wrap | 20 | handle strap |
| 22 | buckle | 24 | buckle strap |
| 26 | hands | 28 | foot |
| 30 | limb (leg) | 32 | heel |
| 34 | plantar surface | 36 | torso strap |
| 38 | first coupler | 40 | second coupler |
| 42 | torso attachment | 44 | bridge strap |

DETAILED DESCRIPTION OF THE INVENTION

Figure 1:
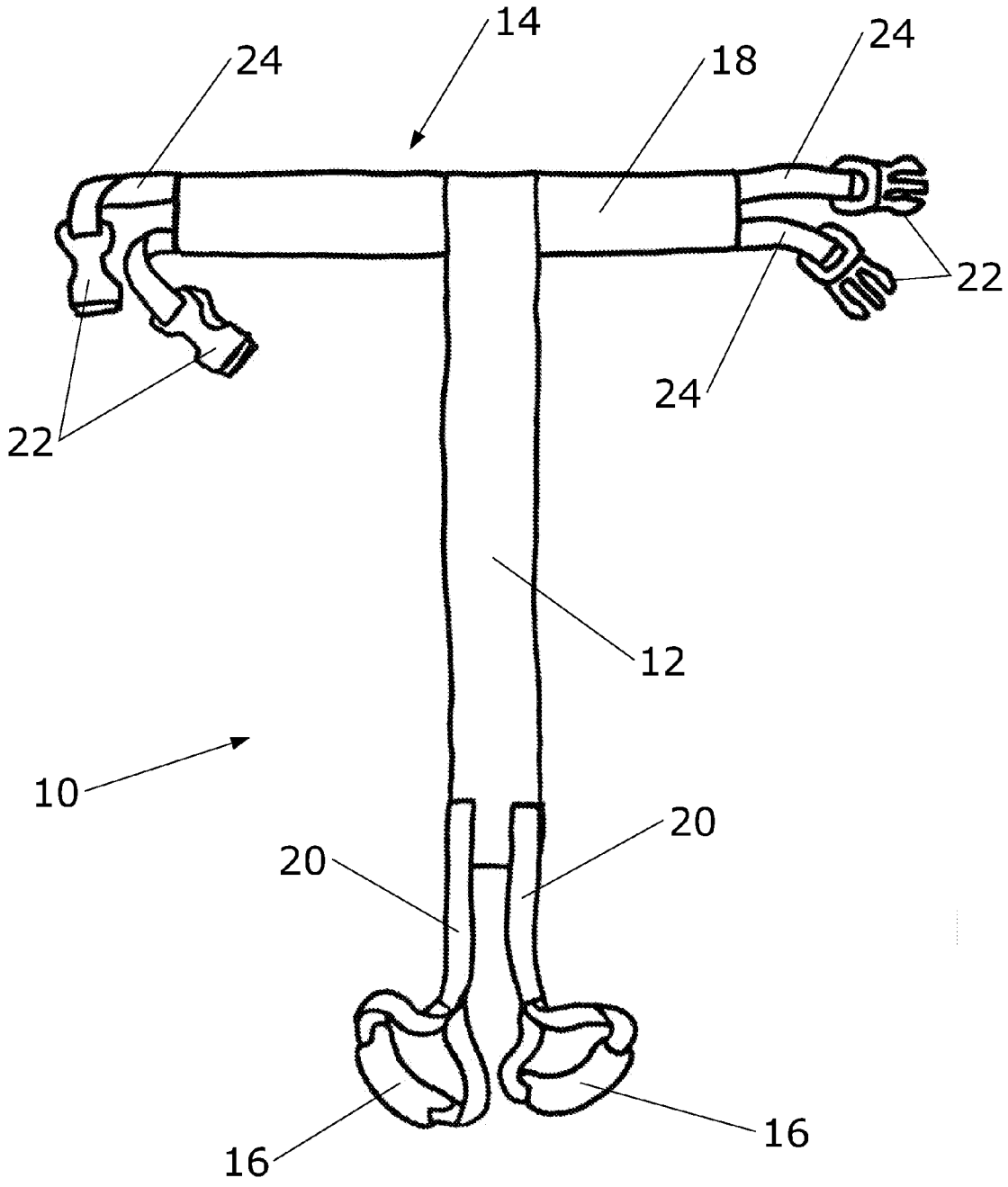
FIG. 1 is a perspective view, showing the present invention.

FIG. 1 illustrates the present invention in the preferred embodiment. The device 10 generally consists of anchor 14, strap 12 and handles 16. Anchor 14 secures device 10 in a set position with respect to the user's leg. Anchor 14, in its preferred embodiment, comprises wrap 18, buckle strap 24 and buckle 22. Anchor 14 is preferably made up of a wide woven nylon strap, but could be any other known material. Anchor 14 connects to foot strap 12. Foot strap 12 is flexible and extends perpendicularly away from anchor 14 to attach to at least one handle strap 20. Foot strap 12 can be made up of any known flexible material, including, but not limited to, an elastic or soft woven material or elastic stretch band, which allows for stretching. Handle strap 20 connects at least one handle 16 to foot strap 12.

Figure 2:
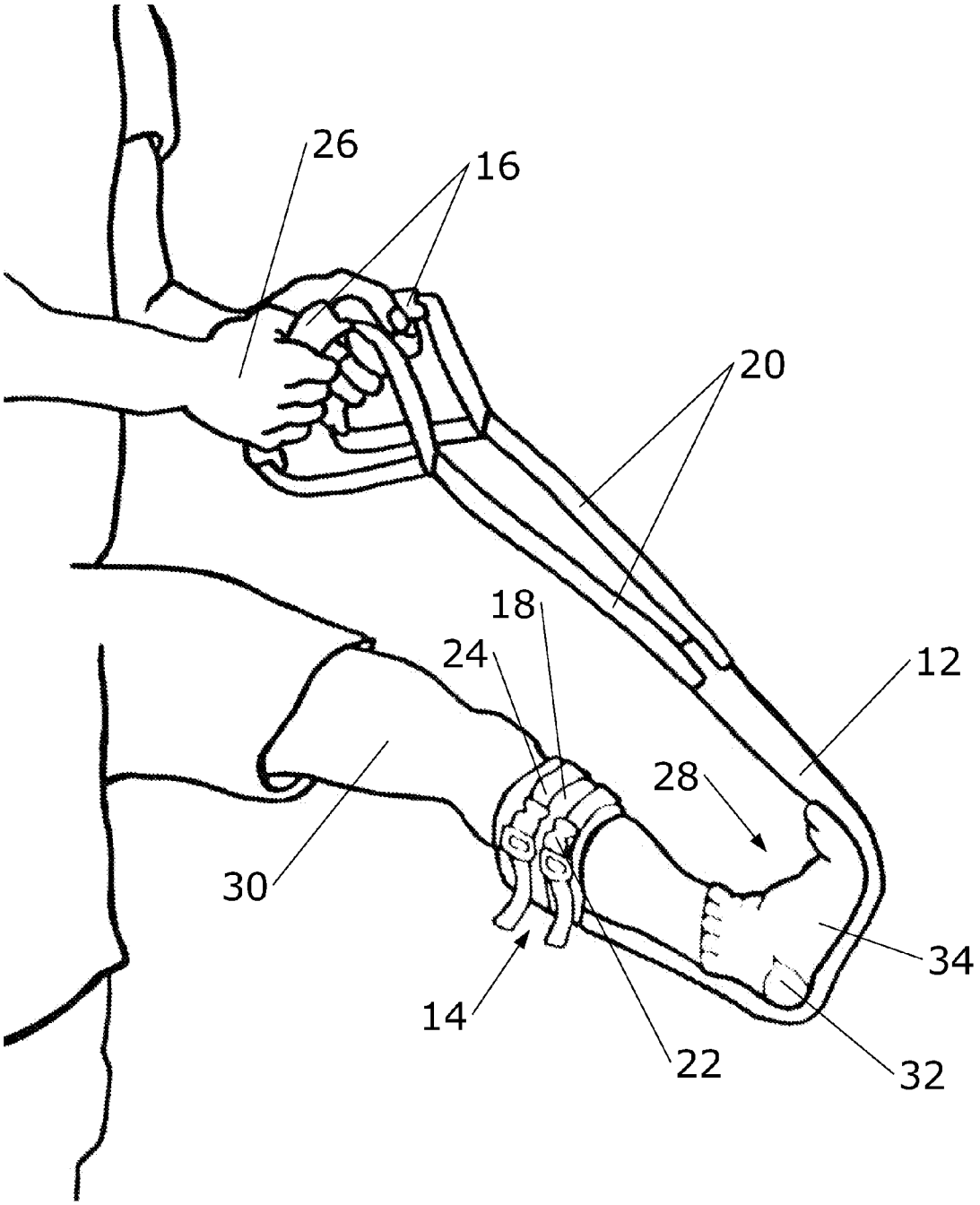
FIG. 2 is a perspective view, showing the present invention anchored to the user's leg proximate the calf muscle.

As illustrated in FIG. 2, device 10 is provided to user and easily attaches to the user's leg 30. In one embodiment, wrap 18 is secured to the user's leg 30 near the calf muscle, just below the knee, by connecting buckles 22 together around the leg. Wrap 18 can be tightened or loosened by adjusting buckle straps 24. Once secure, wrap 18, buckles 22 and buckle straps 24, act as an anchor 14 to the user's leg 30. Foot strap 12 extends from wrap 18 and contacts the user's foot 28 at the heel 32 and plantar surface 34. The orientation of foot strap 12 is important to the device 10 functionality. As the reader will appreciate, device 10 provides passive stretching or dorsiflexion of the foot stretching the gastrocnemius muscle, the soleus muscle and the plantar fascia. Additionally, device 10 passively stretches the hamstring muscles through the use of foot strap 12, which wraps behind the heel 32 of the user under the user's relaxed foot 28, and through the metatarsal arch. After the user secures wrap 14 to himself or herself, the user places the foot strap 12 behind and under their heel at the metatarsal arch and then under and around the user's relaxed foot 28, such that the user is able to grasp and pull back on foot strap handles 16 with both hands 26 facing the relaxed foot and leg.

The wide foot strap 12 attaches perpendicularly to wrap 18 (affixed around the user's leg 30) and on the posterior aspect of the leg 28, travels behind the heel 32 then under the foot 28. The end of foot strap 12 is approximately 6-10 inches longer than the toes and has two handle straps 20 attached each to at least one foot strap handles 16. After the passive exercise device is put in place one pulls back on the handles 16, this action wilt passively dorsiflex the foot and extend all the toes at once. This action in turn stretches the gastrocnemius muscle, the soleus muscle and the plantar fascia. The orientation of foot strap 12 along the user's foot 28 spreads the force exerted by foot strap 12 throughout the entire foot 28. This permits the user to achieve a passive stretch with the foot in a completely relaxed state. Additionally, the flexible nature of foot strap 12 allows the user to achieve a stretch not only on the calf (gastrocnemius) but also along the foot 28 (plantar fascia).

As illustrated the placement of foot strap 12 under the heel 32 continues under the metatarsal arch and under the toes, which pulls the toes into hyperextension. The contact of foot strap 12 along the heel 32 and plantar surface 34 is integral to the functionality of device 10. This contact allows the passive stretching which provides the range of motion exercises for efficacious rehabilitation of an injured foot, ankle, knee and/or back muscles and tendons.

Figure 3:
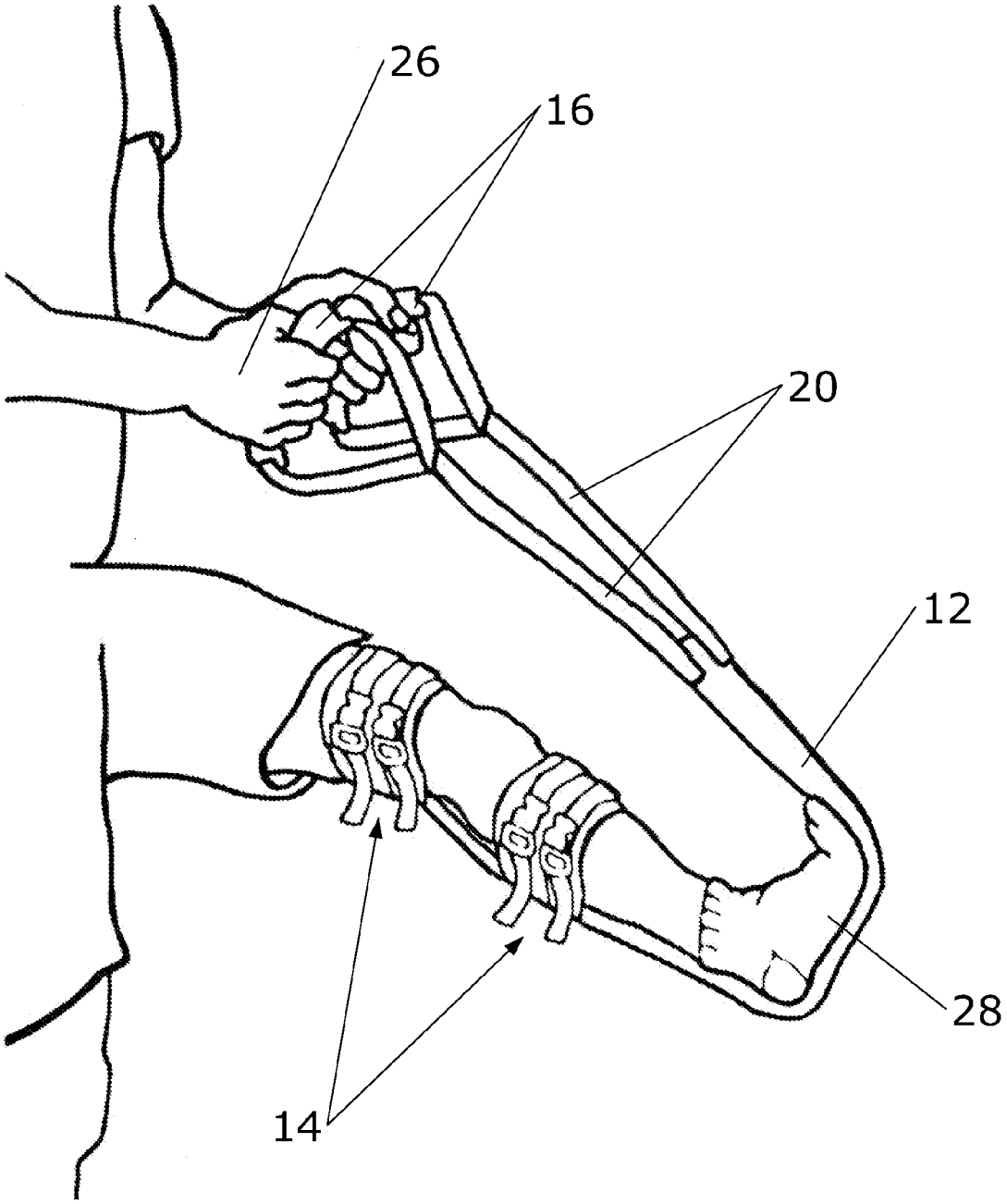
FIG. 3 is a perspective view, showing the present invention anchored to the user's leg in two locations.
Figure 4:
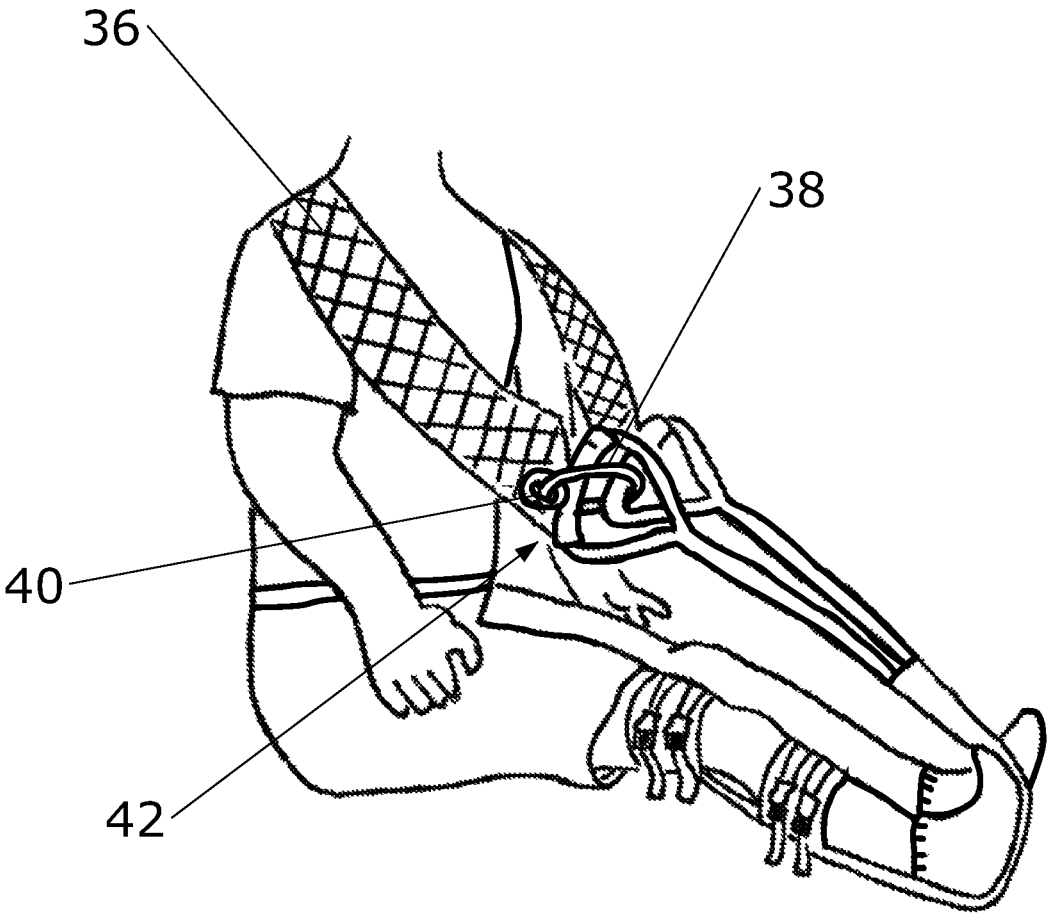
FIG. 4 is a perspective view, showing an alternate embodiment of the present invention.
Figure 5:
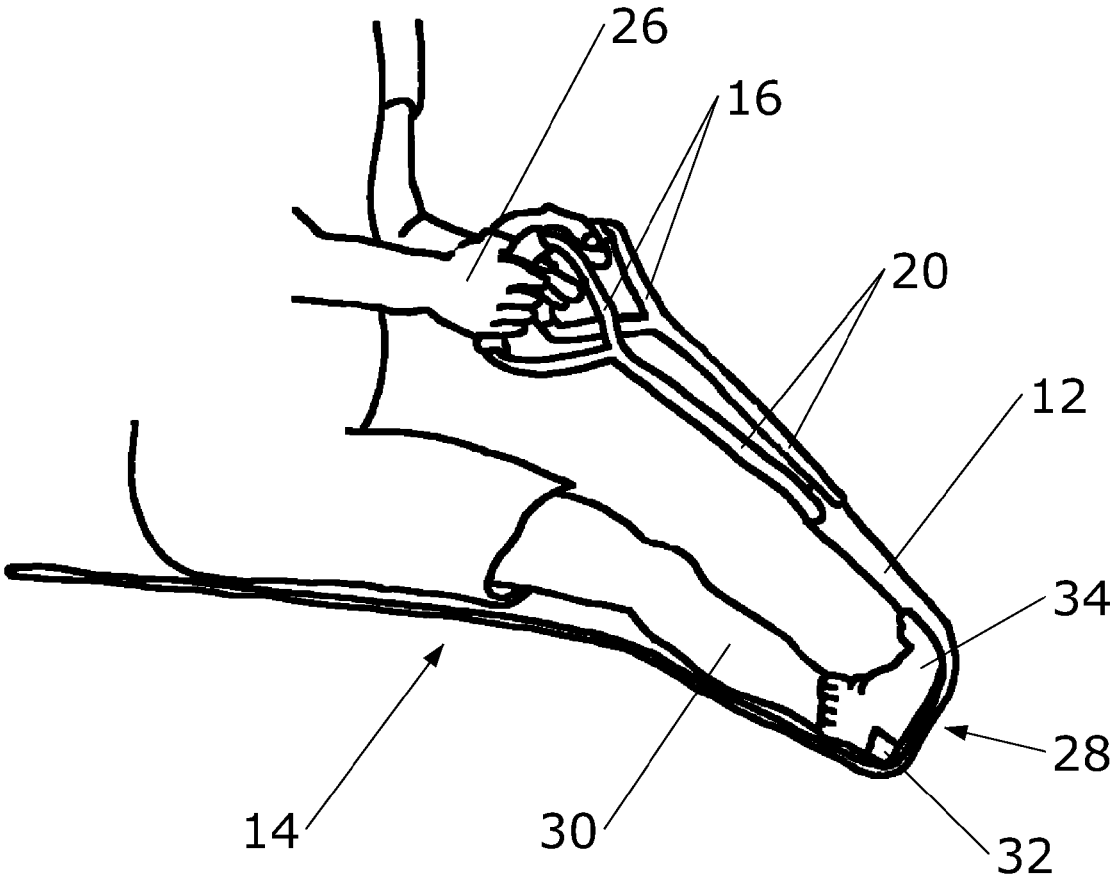
FIG. 5 is a perspective view, showing the present invention anchored underneath the user's leg.

As illustrated in FIG. 3-5 device 10 can be secured to the user through the use of anchor 14 in alternate embodiments. In FIG. 3, device 10 is shown secured to the user by the use of two anchors 14. One anchor 14 is buckled around the user's calf and the second anchor 14 is attached around the user's thigh, as illustrated. Each anchor 14 is comprised of a wrap 18, buckle strap 24 and buckle 22 (as illustrated in FIG. 1). Anchor 14 buckles together and are preferably adjustable. Moreover, the anchor 14 around the thigh is connected to the anchor 14 around the calf by a thigh to calf bridge strap 44. The same elements, or components, that comprise the embodiments as depicted in FIG. 1-2, also comprise the embodiment of the invention as depicted in FIG. 3. Namely, the flexible foot strap 12, extending from anchors 14 is placed on the heel and the plantar surface of the user's foot 28. Foot strap 12 runs under the toes and connects to at least one handle 16 by way of a handle strap 20. The user gently pulls on handles 16 with both hands 26 to achieve the rehabilitative passive stretching desired.

In another embodiment of the claimed invention, as shown in FIG. 4, the passive exercise device 10, is secured to the user by a strap or piece of material that wraps around the user's back and/or shoulders, referred to as a torso strap 36. The embodiment of the invention as depicted in FIG. 4 comprises the same elements as described and shown in FIG. 2-3. Thus, wrap 16 connects to the user's leg 30, which attaches to foot strap 12. Foot strap 12 is placed on the heel and plantar surface of the user's foot 28. However, instead of the user pulling on handles 16 with hands, the device 10 is modified to additionally include torso strap 36. Upon securing device 10, the user leans backwards and torso strap 36 pulls a coupler system 42 which in turn pulls on a plurality of handles 16 which are located at one end of the handle strap 20 to achieve the rehabilitative passive stretch. When performed lying supine, using the embodiment of FIG. 4, with the leg flexed at the hip one will also achieve an effective hamstring stretch.

Coupler system 42 is preferably comprised of a first coupler 38 attached around handles 16 and a second coupler 40 surrounding first coupler 38 and respective ends of torso strap 36. However, any type of coupling system can be utilized to connect torso strap 36 to handle straps 20. Or in the alternative, handle straps 20 can be fully integrated with torso strap 36.

FIG. 5 illustrates a separate embodiment, showing an alternate anchor 14. In the alternate embodiment, anchor 14 (or extended member 14, in the alternate embodiment) is fully integrated with foot strap 12 and is secured by the user's weight. Foot strap 12 extends into anchor 14 as shown and the user sits on anchor 14 to achieve the passive stretch. Anchor 14 can include a wider portion for the user to sit on a textured or abraded surface such that anchor 14 does not slip out from under the weight of user. The weight of the user provides a frictional engagement between the user and the ground surface, such that the device 10 remains in position. In this embodiment the device includes the foot strap 12 which extends under the heel 32 and plantar surface 34 of the user's foot 28. Handle straps 20 attach foot strap 12 to handles 16 such that the user can apply force to handles 16 thereby pulling the user's toes and foot toward the user, achieving the desired stretch.

The preceding description contains significant detail regarding the novel aspects of the present invention. It should not be construed, however, as limiting the scope of the invention but rather as providing illustrations of the preferred embodiments of the invention. Further modifications of the subject matter of this disclosure will also occur to persons skilled in the art, and all are deemed to fall within the spirit and scope of the subject matter of this disclosure. Thus, the scope of the invention should be fixed by the following claims, rather than by the examples given.

Having described my invention, I claim:

1. A stretch device for use by a user, having a torso, in order to passively stretch a leg by applying a force, wherein said leg includes a calf, a thigh and a foot having a longitudinal plane, a heel and toes a plantar surface, said device further comprising a. an anchor, wherein said anchor is configured to be removably attached to said leg of said user;

b. a foot strap having a first end and a second end, wherein said first end is securely affixed to said anchor and said second end is affixed to at least one handle;

c. wherein said foot strap is configured to extend in a perpendicular direction away from said anchor continuously contacting said calf, said heel and said plantar surface of said foot such that said foot strap follows said longitudinal plane of said foot of said user towards said second end, which is configured to extend at least 6 inches past said toes of said user.

2. The device as recited in claim 1, wherein said anchor further comprises:

a. a wrap configured to wrap around said leg of said user;

b. a buckle strap connected to said wrap;
c. a plurality of buckles attached to said buckle strap to attach said anchor to said leg; and
d. wherein said anchor provides a point of support for said force placed upon said foot while stretching.

3. The device as recited in claim 1, further comprising a second anchor, wherein said second anchor connects to said anchor by a bridge strap.

4. The device as recited in claim 1, wherein said anchor further comprises an extended member fully integrated with said foot strap.

5. The device as recited in claim 4, wherein said extended member is configured to extend under said user being secured thereto by frictional engagement with said user.

6. The device as recited in claim 1, wherein said foot strap is flexible.

7. The device as recited in claim 1, further comprising:
a. a torso strap, configured to extend around said torso of said user; and
b. a coupler system configured to attach said at least one handle to said torso strap such that said user can lean backwards and apply a force on said foot strap of said device.

8. The device as recited in claim 1, further comprising a handle strap configured to attach said foot strap to said at least one handle.

9. A stretch device for use by a user, having a torso, in order to passively stretch a leg by applying a force, wherein said leg includes a calf, a thigh and a foot having a longitudinal plane, a heel, toes and a plantar surface, said device further comprising
a. an anchor, wherein said anchor is configured to provide a secure connection to said user;
b. a foot strap having a first end and a second end, wherein said first end is affixed to said anchor and said second end is attached to at least two handles,
c. wherein said foot strap is configured to extend away from said anchor continuously contacting said calf, said heel and said plantar surface of said foot such that said foot strap follows said longitudinal plane of said foot of said user towards said second end, which is configured to extend at least 6 inches past said toes of said user; and
d. wherein said foot strap is configured such that said user can apply a force to said at least two handles thereby flexing said foot and said toes.

10. The device as recited in claim 9, wherein said anchor further comprises:
a. a wrap configured to wrap around said leg of said user;
b. a buckle strap connected to said wrap;
c. a plurality of buckles attached to said buckle strap to attach said anchor to said leg; and
d. wherein said anchor provides a point of support for said force placed upon said foot while stretching.

11. The device as recited in claim 9, further comprising a second anchor, wherein said second anchor connects to said anchor by a bridge strap.

12. The device as recited in claim 9, wherein said anchor further comprises an extended member fully integrated with said foot strap.

13. The device as recited in claim 9, wherein said foot strap is flexible.

14. The device as recited in claim 9, further comprising:
a. a torso strap, configured to extend around said torso of said user; and
b. a coupler system configured to attach said at least two handles to said torso strap such that said user can lean backwards and apply a force on said foot strap of said device.

15. A method of stretching a user's posterior muscles in a lower leg, including a gastrocnemius muscle, a soleus muscle, and a plantar fascia, wherein said user has a calf, a foot having a length and a width and a heel, toes and a plantar surface, said method comprising the steps of:
a. providing a device comprising:
  i. an anchor, wherein said anchor is configured to provide a secure connection to said user;
  ii. a foot strap having a first end and a second end, wherein said first end is affixed to said anchor, and said second end is attached to a plurality of handles;
  iii. wherein said foot strap is configured to extend away from said anchor continuously contacting said calf, said heel and said plantar surface of said foot towards said second end, which is configured to extend at least 6 inches past said toes of said user;
b. attaching said anchor to said user;
c. positioning said foot strap along said calf, said heel and said plantar surface of said foot of said user such that said foot strap rests along said calf and said length of said foot;
d. grasping said plurality of handles attached to said foot strap; and
e. applying a pulling force along said foot of said user at said plurality of handles to achieve a stretch such that said foot and said toes are flexed at the same moment.

16. The method of claim 15, wherein said step of attaching said anchor to said user further comprises wrapping said anchor around said leg of said user.

17. The method of claim 15, wherein said step of attaching said anchor to said user further comprises said user sitting on said anchor.

18. The method of claim 15, further comprising the step of lying supine with said leg flexed at a hip of said user and lifting said leg of said user as said force is applied to said plurality of handles.

* * * * *